US006963025B1

(12) United States Patent
Kysely

(10) Patent No.: US 6,963,025 B1
(45) Date of Patent: Nov. 8, 2005

(54) WILDLIFE PROTECTOR GUARD FOR HIGH VOLTAGE ELECTRICAL TERMINATION

(75) Inventor: Joseph H. Kysely, Palmyra, WI (US)

(73) Assignee: Wisconsin Electric Power Company, Milwaukee, WI (US)

( * ) Notice: Subject to any disclaimer, the term of this patent is extended or adjusted under 35 U.S.C. 154(b) by 0 days.

(21) Appl. No.: 10/844,698

(22) Filed: May 13, 2004

(51) Int. Cl.[7] ..... H01B 13/00
(52) U.S. Cl. ..... 174/5 R; 174/5 SB; 174/138 F; 174/50
(58) Field of Search ..... 174/5 R, 5 SB, 174/138 F, 50

(56) References Cited

U.S. PATENT DOCUMENTS

| | | | | |
|---|---|---|---|---|
| 1,748,650 | A * | 2/1930 | Hollenbeck | 200/19.38 |
| 2,065,315 | A * | 12/1936 | Keath | 174/31 R |
| 2,263,319 | A * | 11/1941 | Treanor | 174/139 |
| 2,875,267 | A * | 2/1959 | Sutton, Jr. | 174/139 |
| 3,238,291 | A * | 3/1966 | Bosch et al. | 174/138 F |
| 3,639,678 | A | 2/1972 | Muschong | |
| 3,639,681 | A | 2/1972 | Ettlinger | |
| 4,201,883 | A | 5/1980 | Shepherd | |
| 4,845,307 | A | 7/1989 | Cumming et al. | |
| 4,906,801 | A | 3/1990 | Beasley | |
| D357,458 | S | 4/1995 | Tisbo | |
| 5,446,242 | A | 8/1995 | Barrett | |
| 5,648,641 | A | 7/1997 | Guthrie | |
| 5,650,594 | A | 7/1997 | Urnovitz | |
| 5,682,015 | A | 10/1997 | Harben | |
| 6,005,196 | A | 12/1999 | Spillyards | |
| 6,098,348 | A | 8/2000 | Weaver | |
| 6,248,956 | B1 | 6/2001 | Cook et al. | |
| 6,291,774 | B1 | 9/2001 | Williams | |
| 6,683,249 | B1 * | 1/2004 | Leppin | 174/50 |

OTHER PUBLICATIONS

*2149 Wildlife Protector; Snap-on Wildlife Protection for High-Voltage Bushings*; Howard Industries, Inc.; ISO-9001 Certified; Document No. 1025-01; 2002.

*BG-9 Wildlife Guard; Overhead Products*; Hendrix Wire & Cable, Inc.; p. A9; (admitted prior art).

*Part Detail: PDM4299; Lightning Arrestors*; Wildlife Outage; *available at* www.nikg.com (last visited Oct. 10, 2003).

*Product Specifications*; Wildlife Outage Protectors; *available at* www.nikg.com (last visited Oct. 10, 2003).

*2163 Wildlife Protector; Snap-on Wildlife Protection for High-Voltage Bushings and Lightning Arresters*; Howard Industries, Inc.; ISO-9001 Certified; Document No. 1024-01; 2002.

*Warco Nordel® Protective Guards*; Warco, Inc.; Manufacturers of Transformer Component Parts and Machinery; Wildlife Guards; *available at* www.warcoinc.com (last visited Nov. 4, 2003).

(Continued)

*Primary Examiner*—Dean A. Reichard
*Assistant Examiner*—Jinhee Lee
(74) *Attorney, Agent, or Firm*—Andrus, Sceales, Starke & Sawall, LLP

(57) ABSTRACT

A wildlife protector guard is provided for a high voltage electrical termination in a high voltage electrical power distribution system. The guard is provided by an electrically insulating shell having a central section concentrically surrounding an axial end of the termination, and having one or more line extension sections extending along and concentrically surrounding a respective given length of a high voltage line conductor connected to an ohmic connection at the axial end of the termination, and having a termination extension section extending along and concentrically surrounding a portion of the termination.

26 Claims, 6 Drawing Sheets

OTHER PUBLICATIONS

*Product Installation Instructions; BCAC; Bushing Connection Animal Cover*; Rachem; Tyco Electronics —Energy; Sep. 11, 2001.

*Wildlife Protection; Distribution Transformer Primary Bushing and Arrester Application*; Central Moloney, Inc. Components Operation; an ISO 9001 Certified Company; *available at* www.centralmoloneyinc.com (last visited Nov. 4, 2003).

Frazier, Sheila D.; *Intruders Impact Reliability*; Transmission & Distribution World; *available at* www.tdworld.com (last visited Nov. 4, 2003); Apr. 1, 2001.

McCann, Carla; *Milton Woman Helps Birds That Get Electrocuted by Power Lines*; GazetteXtra; Jan. 11, 2004.

Vosloo, Hein; *Guarding Against Bird Outages*; Transmission & Distribution World; *available at* www.tdworld.com; (last visited Nov. 4, 2003); Apr. 1, 2001.

* cited by examiner

WILDLIFE PROTECTOR GUARD FOR HIGH VOLTAGE ELECTRICAL TERMINATION

BACKGROUND AND SUMMARY

The invention relates to high voltage electrical power distribution systems, e.g. typically operated by electrical power utility companies, and more particularly to a wildlife protector guard for a high voltage electrical termination in such system.

High voltage electrical power distribution systems include various types of electrical terminations to high voltage power transmission lines, e.g. lightning current surge arrestors, transformer bushings, capacitor bushings, regulator bushings, cable potheads, and so on. Wildlife protector guards are known for preventing an animal, e.g. a bird, squirrel, raccoon, etc., from making electrical contact with such electrical terminations, both phase wire-to-phase wire and phase wire-to-ground. Such guards are desired to protect the animal from injury or death and to prevent electrical power distribution outages. Furthermore, the problem will only continue to increase as utilities convert to even higher voltage distribution systems, which are more susceptible to wildlife contacts, to handle increases in future demand.

The present invention provides a simple and effective wildlife protector guard. Furthermore, the invention provides increased strike distance, namely the distance between points of possible animal contact and the point of ohmic connection of a high voltage electrical termination to a high voltage line conductor.

DETAILED DESCRIPTION

Figure 1:
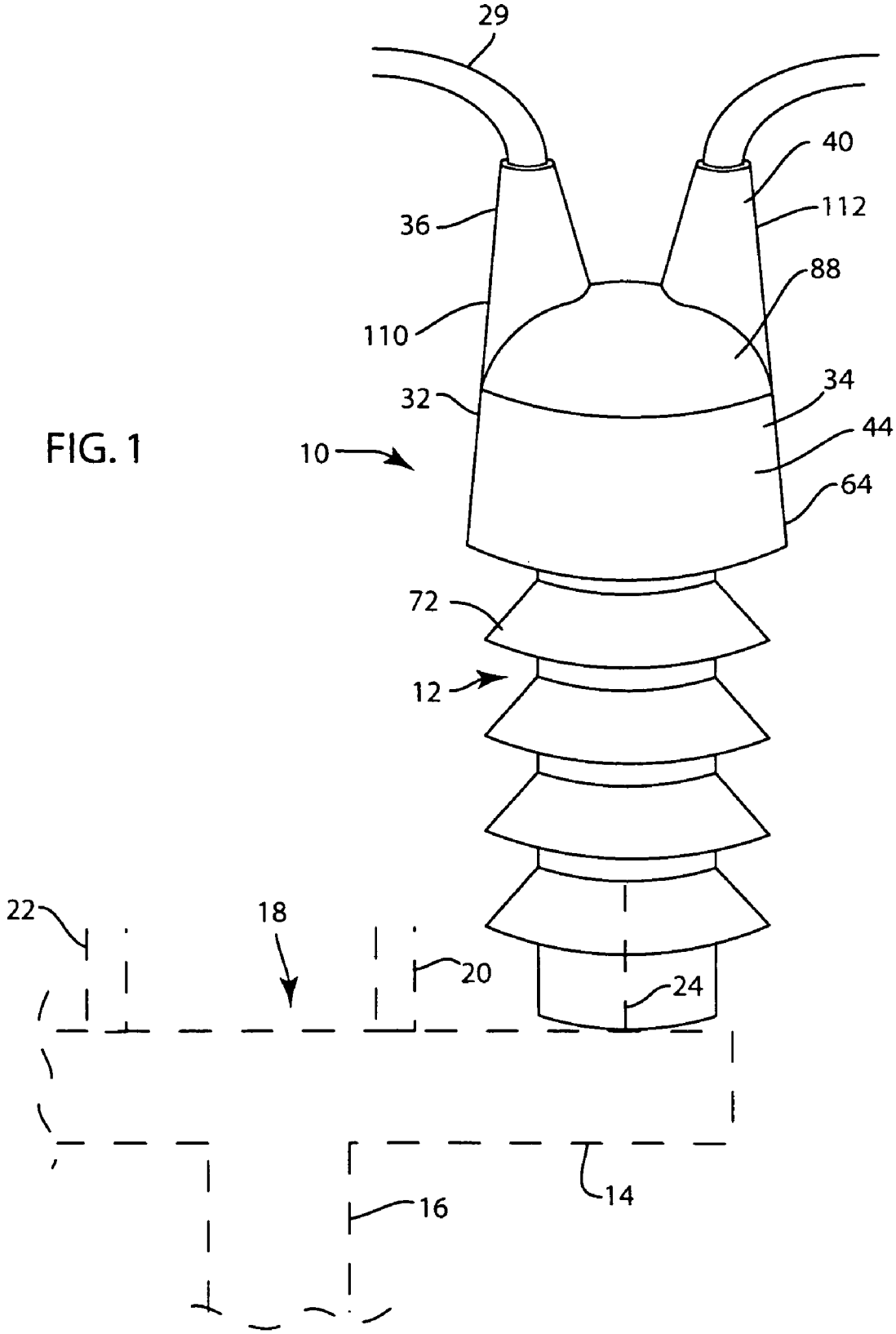
FIG. 1 is a perspective view of a wildlife protector guard for a high voltage electrical termination in accordance with the invention.

FIG. 1 shows a wildlife protector guard 10 for a high voltage electrical termination 12, for example a high voltage power distribution lightning current surge arrestor which may be mounted on a cross arm, shown in dashed line at 14, of a utility pole 16 as part of a high voltage electrical power distribution system 18, and which cross arm may have other high voltage electrical terminations mounted thereon as shown at 20, 22 and so on. In FIG. 1, termination 12 is a lightning current surge arrestor extending axially along axis 24 to an axial end 26, FIG. 2, for ohmic connection at 28 to a high voltage line conductor 29. Conductor 29 may typically carry several thousand volts, e.g. in one embodiment 14 kV (kilovolts). Termination 12 typically includes an MOV (metal oxide varistor) normally nonconductive, but triggered into conduction at a given voltage such as 18 kV, for protection against lightning strikes, by conducting such lightning surge current to ground, all as is well known. Axial end 26 of termination 12 typically has a threaded stud, as shown in dashed line at 30, extending axially therefrom, to which a nut is thread mounted to attach line conductor 29 to the termination. The line conductor typically has multiple strands surrounded by an insulating cover or sheath which is stripped away in the area of termination 12 to enable ohmic connection at 28 to axial end 26. The strands are typically separated to provide a gap therebetween through which stud 30 extends for receiving a clamping nut, all as is known.

Guard 10 is provided by an electrically insulating shell 32, preferably of thermoplastic, thermoset, or rubber material resistant to UV (ultraviolet) exposure, ozone exposure, and carbon arcing tracking, with minimal degradation over time. The shell has a central section 34 concentrically surrounding axial end 26 of termination 12, and having a first extension section 36 providing a first line extension section extending from central section 34 along and concentrically surrounding a given length 38 of line conductor 29 leading to ohmic connection 28 at axial end 26 of termination 12, whereat the line conductor is connected to ohmic connection 28, and having a second extension section 40 providing a second line extension section extending from central section 34 along and concentrically surrounding a second given length 42 of the line conductor leading from ohmic connection 28, and having a third extension section 44 providing a termination extension section extending from central section 34 along and concentrically surrounding a portion of termination 12. First line extension section 36 of the guard extends to a first outer lip 46 defining a first opening 48 receiving the noted first given length 38 of line conductor 29 extending therethrough. Second line extension section 40 of the guard extends to a second outer lip 50 defining a second opening 52 receiving the noted second given length 42 of the line conductor extending therethrough. Termination extension section 44 extends to a third outer lip 54 defining a third opening 56 receiving termination 12 extending therethrough. First and second line extension sections 36 and 40 of the guard extend in a first axial direction (upwardly in FIGS. 1, 2) away from termination 12. Termination extension section 44 of the guard extends in a second axial direction (downwardly in FIGS. 1, 2) opposite to the noted first axial direction.

Outer lip 46 of line extension section 36 is spaced from ohmic connection 28 by a line strike distance 58. Outer lip 50 of line extension section 40 is spaced from ohmic connection 28 by a line strike distance 60. Outer lip 54 of termination extension section 44 is spaced from ohmic connection 28 by a termination strike distance 61. In the disclosed preferred embodiment, termination strike distance 61 is no less than 65% of each of line strike distances 58 and 60. Further preferably, guard 10 enables each of the line strike distances 58 and 60 to be greater than 3 inches, and further preferably 3.5 inches, and enables termination strike distance 60 to be greater than 2 inches and further preferably 2.5 inches. These strike distances sufficiently space the possible points of animal contact at lips 46, 50, 54 from ohmic connection 28 to protect wildlife, and to protect and ensure the reliability of the electrical power distribution system.

Figure 2:
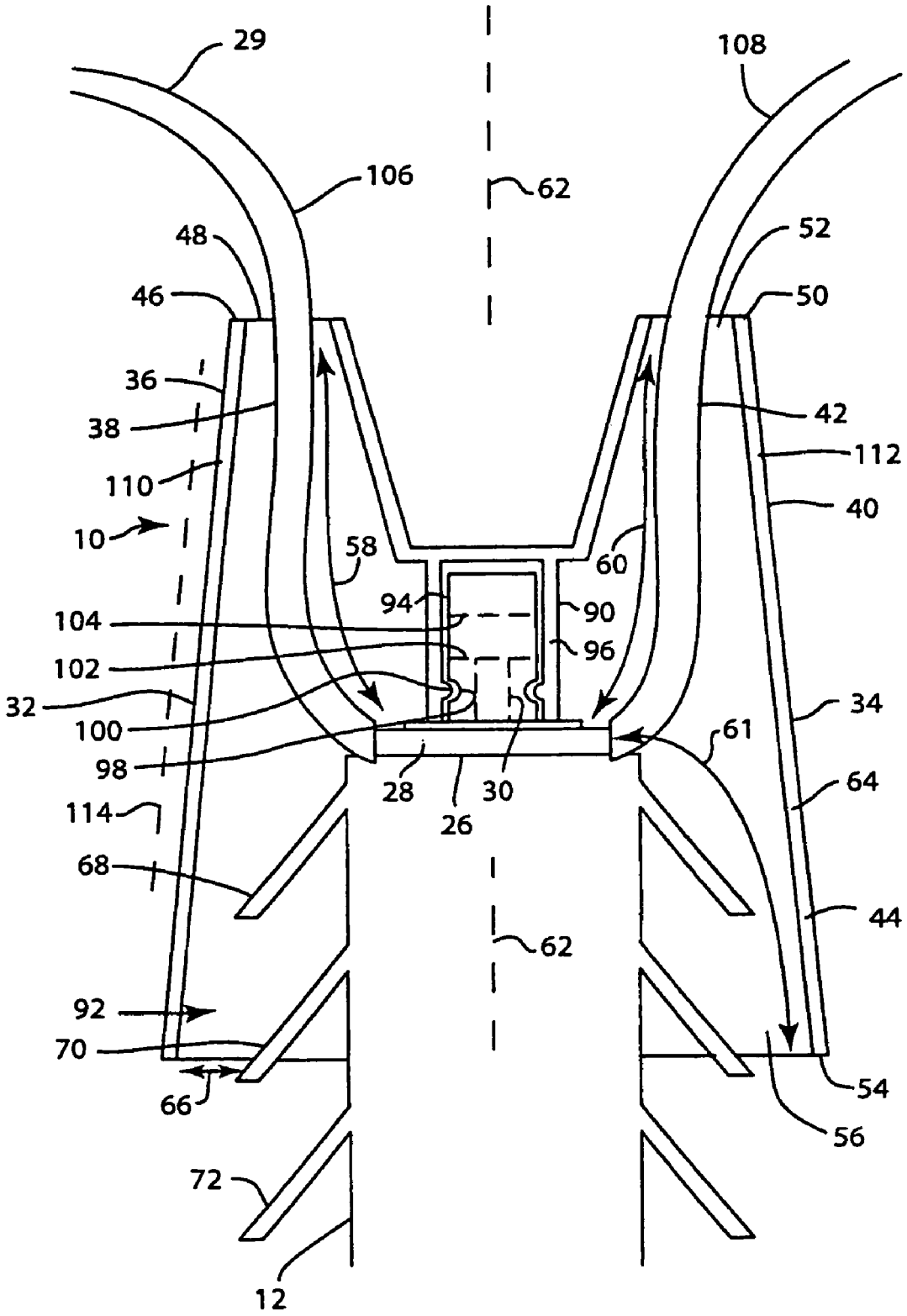
FIG. 2 is a sectional view of the guard of FIG. 1.
Figure 3:
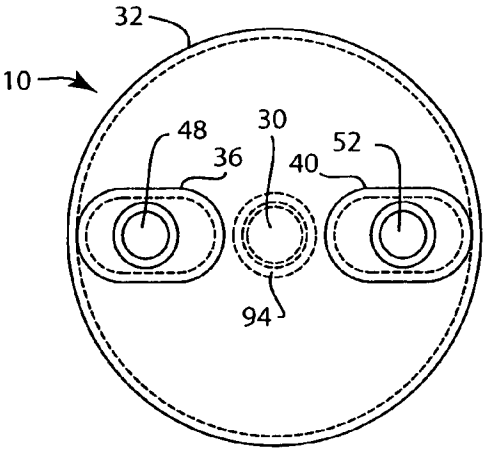
FIG. 3 is a top elevation view of the guard of FIG. 1.

Termination 12 has an axially extending centerline 62, FIG. 2. Each of the line openings 48 and 50 is laterally offset from centerline 62. Termination opening 56 is axially aligned with centerline 62, and has a diameter substantially greater than the diameter of each of the line openings 48 and 52. Termination extension section 44 has an axially extending tapered sidewall 64 spaced radially outwardly of termination 12. Outer lip 54 of termination extension section 44 defining termination opening 56 is spaced radially outwardly of termination 12 by a radial gap 66 therebetween. Termination 12 has a plurality of annular skirts 68, 70, 72, etc. axially spaced therealong, for providing increased high voltage leakage path distance, as is known. Sidewall 64 of termination extension section 44 extends axially past at least a first of the skirts 68 closest to ohmic connection 28. Sidewall 64 and termination extension section outer lip 54 are spaced radially outwardly of the skirts.

Figure 4:
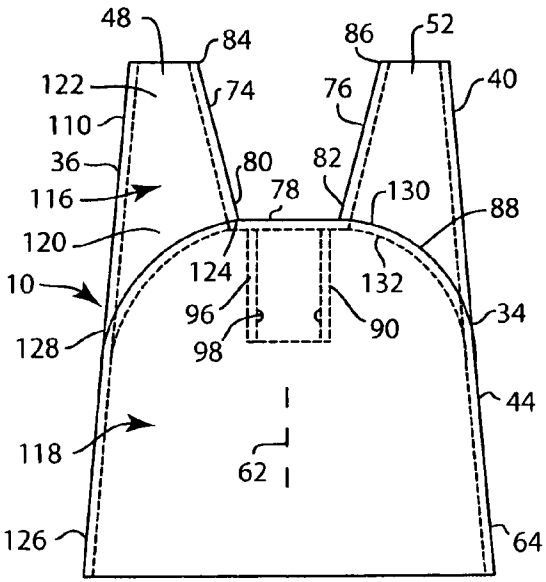
FIG. 4 is a front elevation view of the guard of FIG. 1.

Termination 12 lies in an axially extending plane, e.g. into and out of the page in FIGS. 2, 4, through axial centerline 62. First and second line extension sections 36 and 40 of the guard are laterally spaced on opposite lateral sides of such plane, e.g. left and right in FIGS. 1–4, and define a U-shape having first and second legs 74 and 76, FIG. 4, joined by a bight 78. First and second legs 74 and 76 have respective first and second root ends 80 and 82 at bight 78 and extend axially in the noted first axial direction (upwardly in FIG. 4) away from bight 78 to respective outer ends 84 and 86 at respective first and second openings 48 and 52. Bight 78 is intersected by the noted axially extending plane extending through centerline 62 into and out of the page in FIG. 4. Termination 12 has a lateral width transverse to axis 24. Openings 48 and 52 are laterally spaced by a lateral dimension at least as great as the noted lateral width of termination 12. The diameter of termination extension section opening 56 is greater than the noted lateral width of the termination. Each of openings 48 and 52 is laterally offset from centerline 62, and opening 56 is axially aligned with centerline 62.

Figure 5:
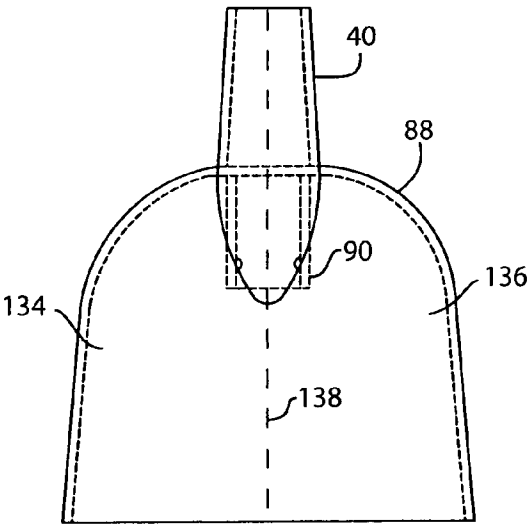
FIG. 5 is a side elevation view of the guard of FIG. 1.

As noted above, known electrical terminations 12 typically have a stud 30, FIG. 2, extending axially therefrom. Central section 34 of the guard has a domed cap portion 88, FIGS. 1, 4, 5, extending axially and laterally around axial end 26 of termination 12 and stud 30. Domed cap portion 88 has an internal downwardly extending mounting segment 90 which is mounted to stud 30 to attach guard 10 to termination 12. Guard 10 is mounted to termination 12 at stud 30 independently of and without engagement nor attachment of termination extension section 44 nor outer lip 54 to termination 12. This is in contrast to guards known in the prior art which engage or attach to a skirt such as 68 or 70 of termination 12. The noted independent mounting of the present guard, including the enablement of gap 66, is desirable to eliminate a leakage and/or contamination path from the termination along the skirts to the guard, and also to enable wind driven rain to cleanse and wash skirts such as 68 and 70 to reduce contamination therealong which might otherwise promote current leakage.

Guard 10 is trapped at axial end 26 of termination 12 by the noted first and second given lengths 38 and 42 of line conductor 29 extending through first and second line extension section openings 48 and 52, respectively. Mounting segment 90 mounts the guard to stud 30 and centers the guard on the stud such that radial gap 66 is constant around an annulus 92 between termination 12 and outer lip 54 of termination extension section 44. Stud 30 and the center of annulus 92 are axially aligned and axially coincident along axial centerline 62.

In the prior art, line conductor 29 is typically mounted to axial end 26 of termination 12 by a nut threaded onto stud 30. In the present guard, the typical nut is replaced by an axially elongated nut 94 threaded onto stud 30 and modified as noted below. Mounting segment 90 of domed cap portion 88 is provided by a sleeve 96 extending axially in the noted second axial direction (downwardly in FIGS. 2, 4), and engaging nut 94 and axially slidable therealong to locate and mount guard 10 on stud 30. In one embodiment, sleeve 96 of mounting segment 90 is mounted to stud 30 at nut 94 in detent snap-fit relation as provided by a laterally recessed groove 98 in one of the nut and sleeve, for example in nut 94, and a lateral protrusion 100 in the other of the nut and sleeve, for example in sleeve 96, mating with groove 98 in snap-fit detent relation upon axial sliding of sleeve 96 along nut 94. Alternatively, or additionally, the mounting segment 90 at sleeve 96 may be mounted to stud 30 at nut 94 in friction fit relation by a tight sliding fit of sleeve 96 along nut 94. In another embodiment, nut 94 may be replaced by first and second nuts as shown in dashed line at 102 and 104 thread mounted to an elongated stud 30. Sleeve 96 initially engages nut 104 and axially slides therealong during downward movement of guard 10, and then engages nut 102 and axially slides therealong to locate and mount guard 10 on stud 30. The cumulative span of nuts 102 and 104 provides extended axial engagement span along sleeve 96. Nuts 102 and 104 may engage each other, or may be axially spaced from each other by an axial gap therebetween. It is desirable that mounting segment 90 of dome shaped cap portion 88 mount guard 10 to stud 30 and center the guard on the stud such that radial gap 66 is constant around annulus 92 between termination 12 and outer lip 56 of termination extension section 44. It is desirable that mounting segment 90 at axially extending sleeve 96 engage stud 30, e.g. at nut 94, or nuts 102, 104, and axially slide therealong and have sufficient axial span to locate and mount guard 10 on stud 30 in centered relation and resist rocking of the guard on the stud such that radial gap 66 around annulus 92 remains substantially constant. Line conductor 29 curves at 106 and 108 as it exits openings 48 and 52, respectively, such that guard 10 is trapped in place by the line conductor extending through line extension sections 36 and 40. This trapping function provided by the line conductor further facilitates the noted centering function by mounting segment 90 to be afforded in a simple effective manner by a snap-fit detent engagement, or the like. The mechanical support for line conductor lengths 38 and 42 provided by line extension sections 36 and 40 of the guard minimizes fatigue due to wind vibration.

Each of the noted line extension sections 36 and 40 of guard 10 has an axially extending sidewall 110, 112, respectively, spaced radially outwardly of its respective segment 38 and 42 of the line conductor. Termination extension section 44 has the noted axially extending sidewall 64 spaced radially outwardly of termination 12. Each of sidewalls 64, 110, 112 is tapered to permit nested stacking of multiple guards, for example as shown at second guard 114 in dashed line, for shipping efficiency. Each of line extension sections 36 and 40 is nestable into a line extension section of another guard. Termination extension section 44 is nestable into the termination extension section of such other guard. Each of line extension sections 36 and 40 has a cross-sectional frusto-triangular shape, for example as shown at 116 in FIG. 4. Termination extension section 44 has a cross-sectional tapered inverted cup shape as shown at 118. Line extension section 36 extends in the noted first axial direction (upwardly in FIG. 4) away from termination 12 and has sidewalls 110, 74 tapering towards each other as they extend axially in the noted first axial direction such that cross-sectional frusto-triangular shape 116 has a wider base section 120 at central section 34 of the guard, and has a narrower frusto-tip section 122 spaced from base section 120 along the noted first axial direction. Central section 34 of guard 10 has the noted domed cap portion 88 extending axially and laterally around axial end 26 of termination 12 and providing a base portion 124 of inverted cup shape 118, and having sidewalls 64, 126 extending axially in the noted second axial direction (downwardly in FIG. 4) away from base portion 124 and tapered away from each other as they extend axially in the noted second axial direction. Base section 120 of frusto-triangular shape 116 is at base portion 124 of inverted cup shape 118. Sidewalls 110 and 126 of the line extension section and termination extension section, respectively, merge with each other as shown at 128 and are tapered relative to axis 24. Sidewalls 110 and 126 merge along a rectilinear line 126-128-110 tapered toward axial centerline 62 as such rectilinear line extends from sidewall 126 of termination extension section 44 to sidewall 110 of line extension section 36.

Dome shaped cap portion 88 of the guard has a convex surface 130 facing in the noted first axial direction (upwardly in FIG. 4) away from termination 12, and has a concave surface 132 facing in the noted second opposite axial direction (downwardly in FIG. 4) toward termination 12. Each line extension section 36, 40 extends from convex surface 130 axially in the noted first axial direction. Mounting segment 90 extends from concave surface 132 in the noted second axial direction and engages axial end 26 of termination 12 at stud 30 and nut 94 for mounting guard 10 thereto. In one embodiment, guard 10 is a unitary integrally molded one-piece member. In another embodiment, including for retrofitting, the guard is a two-piece member having first and second pieces 134 and 136, FIG. 5, joined at parting line 138 and mounted to each other in any suitable manner, such as clamps or the like.

Figure 6:
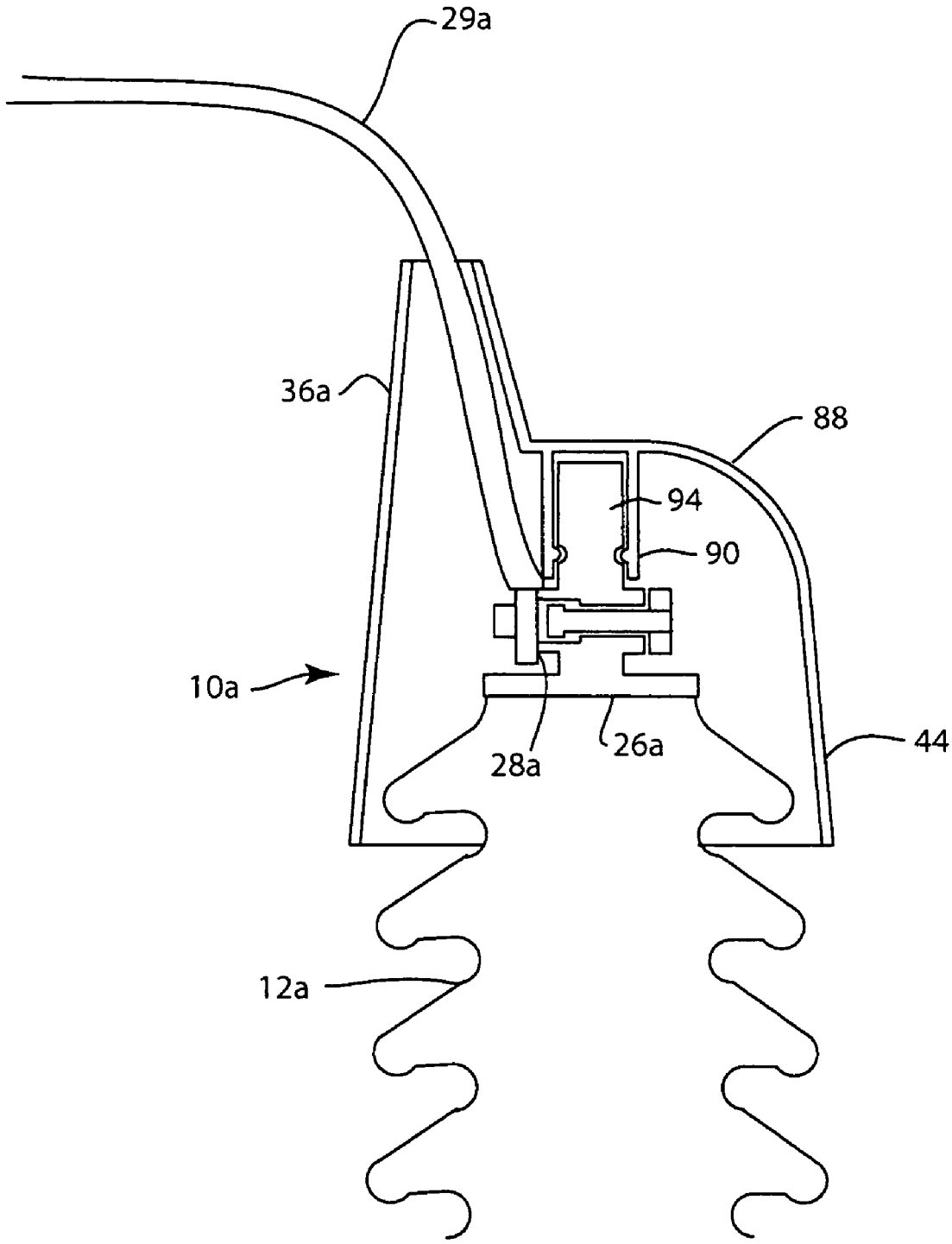
FIG. 6 is a sectional view like FIG. 2 but showing an alternate embodiment.

FIGS. 1–5 show a guard 10 for a lightning current surge arrestor and having a pair of line extension sections 36 and 40. FIG. 6 shows a further embodiment and uses like reference numerals from above where appropriate to facilitate understanding. FIG. 6 shows a guard 10*a* for a transformer bushing or the like 12*a* and has a single line extension section 36*a* for line conductor 29*a* connected to axial end 26*a* of the termination at ohmic connection 28*a*, for example at a side mount as is known.

Figure 7:
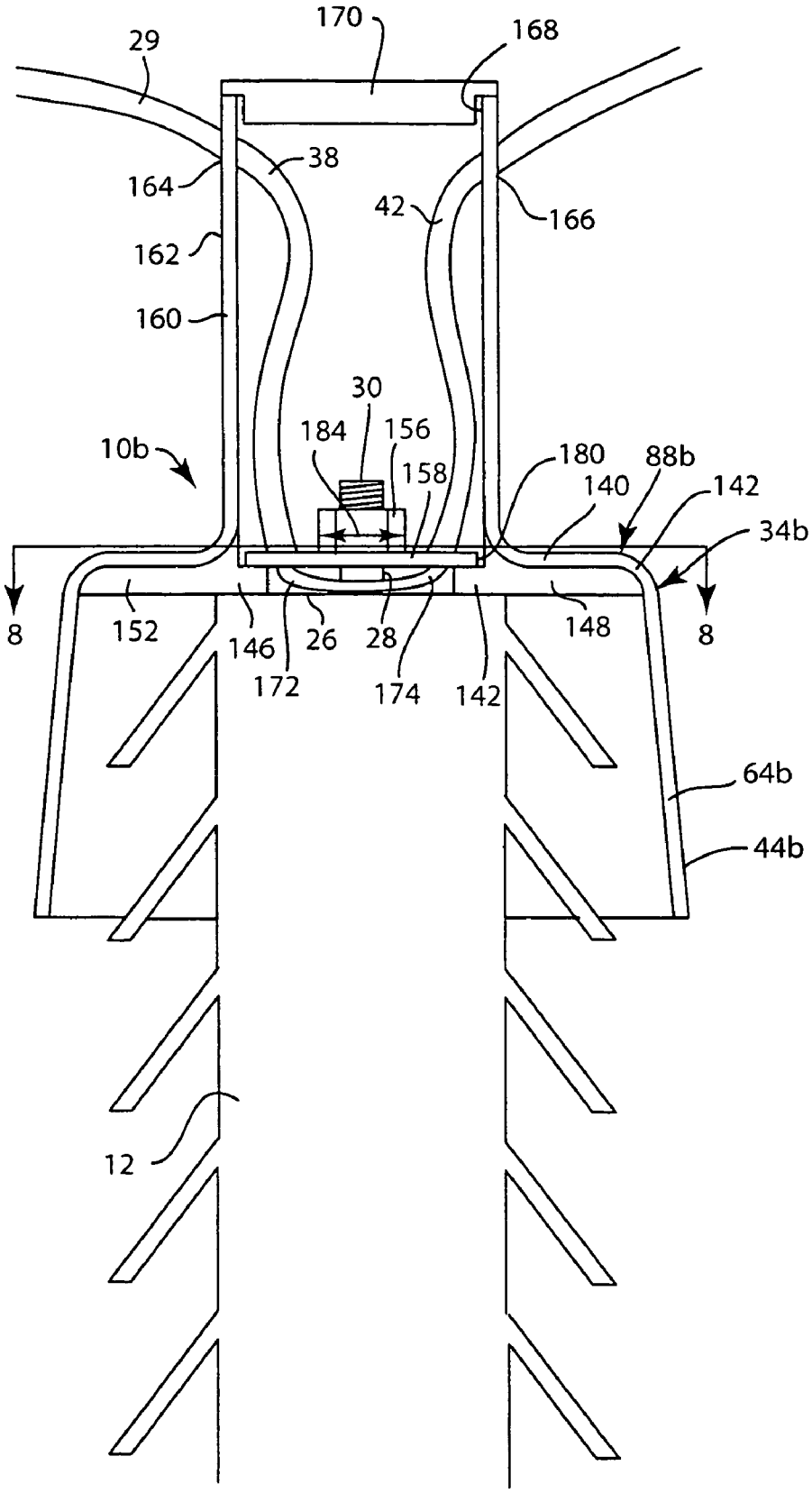
FIG. 7 is a sectional view like FIG. 2 but showing another embodiment.
Figure 8:
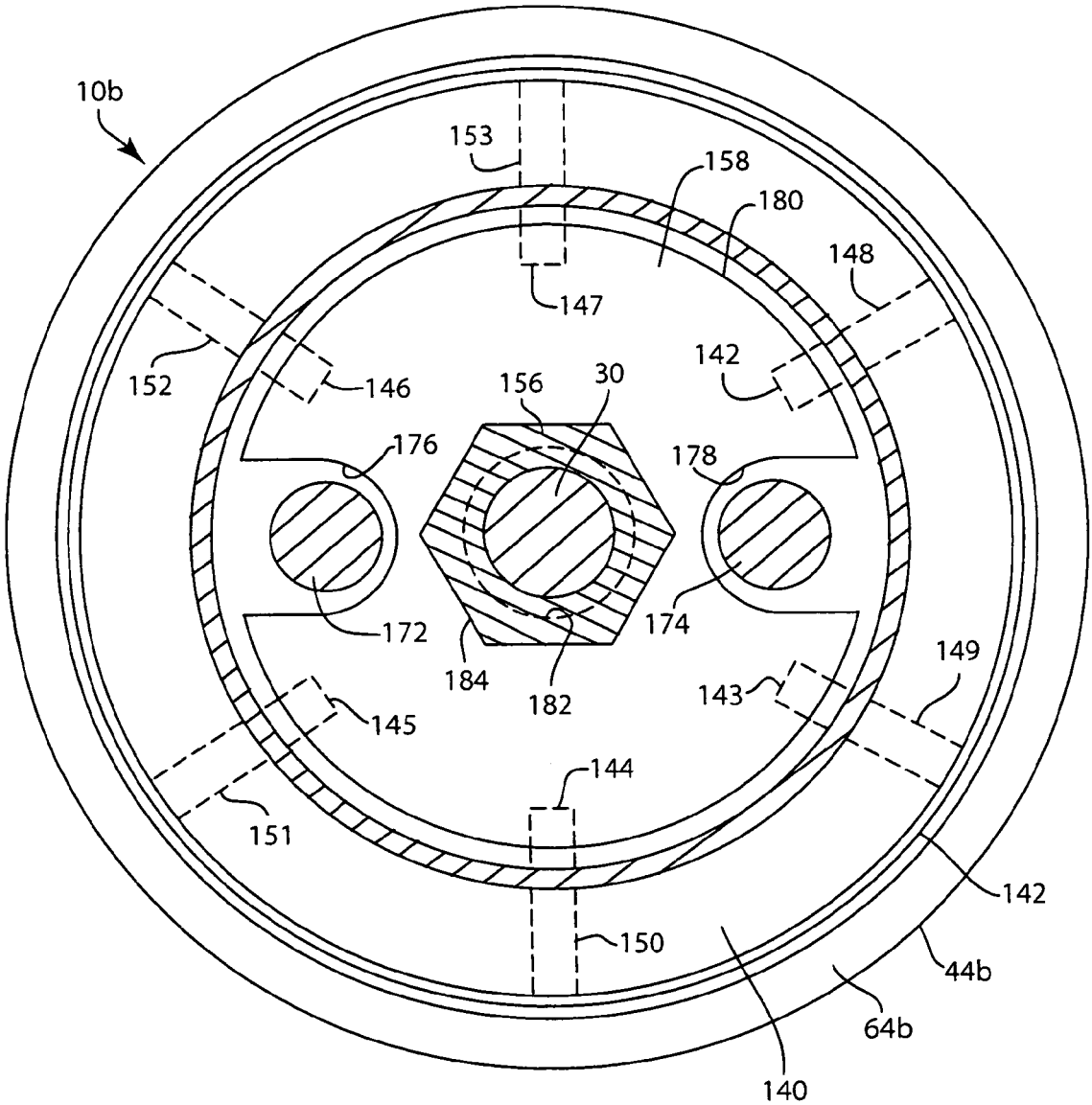
FIG. 8 is an enlarged sectional view taken along line 8—8 of FIG. 7.

FIGS. 7 and 8 show a further embodiment and use like reference numerals from above where appropriate to facilitate understanding. Guard 10*b* has a central section 34*b* with domed cap portion 88*b* having a generally flat plateau segment 140 rounded at outer bend 142 and then tapered along sidewall 64*b* of termination extension section 44*b*. Central section 34*b* has one or more interior shoulders 142, 143, 144, 145, 146, 147 formed by the inner radial tips of one or more respective radial ribs 148, 149, 150, 151, 152, 153 along the interior surface of segment 140 at axial end 26 of termination 12. Nut 156 is threaded on stud 30, and a washer 158 around stud 30 is axially between nut 156 and shoulders 142–147 to mount guard 10*b* to stud 30 and trap shoulders 142–147 between washer 158 and axial end 26 of termination 12. Sidewall 160 of line extension section 162 of the guard has at least one opening 164, and in case of a lightning current surge arrestor, a second opening 166, receiving line conductor 29 extending therethrough. Line extension section 162 has a nut-access opening 168 allowing access to nut 156. A removable closure cover 170 closes nut-access opening 168 and is removable therefrom to enable access to nut 156. Line opening 164 receives first segment 38 of line conductor 29 leading to ohmic connection 28, and second opening 166 receives second segment 42 of the line conductor leading from ohmic connection 28. Washer 158 trappingly mounts the line conductor to axial end 26 of termination 12, preferably by means of stud 30 extending between separated strands of the line conductor. The line conductor is mounted to axial end 26 of termination 12 at bends 172, 174 of the line conductor extending through respective slots or cut-outs 176, 178, FIG. 8, in washer 158. Washer 158 has an outer diameter 180 engaging and overlying shoulders 142–147. Slots 176, 178 extend radially inwardly from outer diameter 180 and receive line conductor 29 therethrough as shown at bend segments 172, 174. Washer 158 has an inner diameter 182 receiving stud 30 therethrough. Nut 156 has an outer diameter 184 less than outer diameter 180 of washer 158 and greater than inner diameter 182 of the washer. Slots 176 and 178 are distally spaced on opposite lateral sides of stud 30. Different numbers of ribs 148–153 may be used, as well as different types of one or more retention shoulders 142–147.

It is recognized that various equivalents, alternatives and modifications are possible within the scope of the appended claims.

What is claimed is:

1. A wildlife protector guard for a high voltage electrical termination in a high voltage electrical power distribution system, said termination extending axially along an axis to an axial end for ohmic connection to a high voltage line conductor, said guard comprising an electrically insulating shell having a central section concentrically surrounding said axial end of said termination and having a first extension section extending from said central section along and concentrically surrounding a given length of a first line conductor segment leading to said ohmic connection at said axial end of said termination, a second extension section extending from said central section along and concentrically surrounding a second given length of a second line conductor segment leading from said ohmic connection at said axial end of said termination, and a third extension section extending from said central section along and concentrically surrounding a portion of said termination, wherein said first extension section of said guard extends to a first outer lip defining a first opening receiving said first given length of said first line conductor segment extending therethrough, said second extension section of said guard extends to a second outer lip defining a second opening receiving said second given length of said second line conductor segment extending therethrough, said third extension section of said guard extends to a third outer lip defining a third opening receiving said termination extending therethrough, said first and second extension sections of said guard extend in a first axial direction away from said termination, said third extension section of said guard extends in a second axial direction opposite to said first axial direction, said termination lies in an axially extending plane, said first and second extension sections of said guard are laterally spaced on opposite lateral sides of said plane and define a U-shape having first and second legs joined by a bight, said first and second legs having respective first and second root ends at said bight and extending axially in said first axial direction away from said bight to respective first and second outer ends at respective said first and second openings, said bight being intersected by said axially extending plane.

2. The wildlife protector guard according to claim 1 wherein said third extension section of said guard comprises an axially extending sidewall spaced radially outwardly of said termination, and wherein said third outer lip defining said third opening is spaced radially outwardly of said termination by a radial gap therebetween.

3. The wildlife protector guard according to claim 2 wherein said termination comprises a plurality of annular skirts axially spaced therealong, said sidewall of said third extension section of said guard extends axially past at least a first of said skirts closest to said ohmic connection, and said sidewall and said third outer lip are spaced radially outwardly of said skirts.

4. The wildlife protector guard according to claim 1 wherein said first extension section of said guard extends to a first outer lip defining a first opening receiving said first given length of said first line conductor segment extending therethrough, said second extension section of said guard extends to a second outer lip defining a second opening receiving said second given length of said second line conductor segment extending therethrough, said third extension section of said guard extends to a third outer lip defining a third opening receiving said termination extending therethrough, said first outer lip is spaced from said ohmic connection by a first strike distance, said second outer lip is spaced from said ohmic connection by a second strike distance, said third outer lip is spaced from said ohmic connection by a third strike distance.

5. The wildlife protector guard according to claim 4 wherein said third opening has a diameter substantially greater than the diameter of each of said first and second openings.

6. The wildlife protector guard according to claim 5 wherein said termination has a lateral width transverse to said axis, said first and second openings are laterally spaced by a lateral dimension at least as great as said lateral width of said termination, and said diameter of said third opening is greater than said lateral width of said termination.

7. The wildlife protector guard according to claim 6 wherein said termination has an axially extending centerline, each of said first and second openings is laterally offset from said centerline, and said third opening is axially aligned with said centerline.

8. The wildlife protector guard according to claim 4 wherein the length of said third strike distance is at least 65% of the length of each of said first and second strike distances.

9. The wildlife protector guard according to claim 4 wherein the length of said first strike distance is at least 3 inches, the length of said second strike distance is at least 3 inches, and the length of said third strike distance is at least 2 inches.

10. A wildlife protector guard for a high voltage electrical termination in a high voltage electrical power distribution system, said termination extending axially along an axis to an axial end for ohmic connection to a high voltage line conductor, said guard comprising an electrically insulating shell having a central section concentrically surrounding said axial end of said termination, and having at least one line extension section extending from said central section along and concentrically surrounding a given length of said line conductor connected to said ohmic connection at said axial end of said termination, and having a termination extension section extending from said central section along and concentrically surrounding a portion of said termination, wherein said at least one line extension section of said guard extends to a first outer lip defining a line opening receiving said given length of said line conductor extending therethrough, said termination extension section of said guard extends to a second outer lip defining a termination opening receiving said termination extending therethrough, said first outer lip of said at least one line extension section being spaced from said ohmic connection by a line strike distance, said second outer lip of said termination extension section being spaced from said ohmic connection by a termination strike distance, said axial end of said termination has a stud extending axially therefrom, said central section of said guard has a domed cap portion extending axially and laterally around said axial end of said termination and said stud, said domed cap portion having a mounting segment mounted to said stud to attach said guard to said termination.

11. The wildlife protector guard according to claim 10 wherein said guard is mounted to said termination at said stud independently of and without engagement nor attachment of said termination extension section nor said second outer lip of said termination extension section to said termination.

12. The wildlife protector guard according to claim 11 comprising first and second said line extension sections each extending from said central section, said first line extension section extending along and concentrically surrounding a first given length of a first line conductor segment leading to said ohmic connection at said axial end of said termination, said second line extension section extending along and concentrically surrounding a second given length of a second line conductor segment leading from said ohmic connection at said axial end of said termination, said first line extension section extending to said first outer lip defining a first line opening receiving said first given length of said first line conductor segment extending therethrough, said second line extension section extending to a third outer lip defining a second line opening receiving said second given length of said second line conductor segment extending therethrough, and wherein said guard is trapped at said axial end of said termination by said first and second given lengths of said first and second line conductor segments extending through said first and second line openings, respectively.

13. The wildlife protector guard according to claim 11 wherein said termination extension section of said guard comprises an axially extending sidewall spaced radially outwardly of said termination, said second outer lip of said termination extension section defining said termination opening is spaced radially outwardly of said termination by a radial gap therebetween, and wherein said mounting segment mounts said guard to said stud and centers said guard on said stud such that said radial gap is constant around an annulus between said termination and said second outer lip of said termination extension section.

14. The wildlife protector guard according to claim 13 wherein said termination extends axially along an axial centerline, and said stud and the center of said annulus are axially aligned and axially coincident along said axial centerline.

15. The wildlife protector guard according to claim 10 wherein said mounting segment of said domed cap portion is mounted to said stud in detent relation.

16. The wildlife protector guard according to claim 10 wherein said mounting segment of said domed cap portion is mounted to said stud in snap-fit relation.

17. The wildlife protector guard according to claim 10 wherein said mounting segment of said domed cap portion is mounted to said stud in friction fit relation.

18. The wildlife protector guard according to claim 10 wherein said stud has a nut threaded thereto, said mounting segment has an axially extending sleeve engaging said nut and axially slidable therealong to locate and mount said guard on said stud.

19. The wildlife protector guard according to claim 18 wherein one of said nut and said sleeve has a laterally recessed groove, and the other of said nut and said sleeve has a lateral protrusion mating with said groove in detent relation upon axial sliding of said sleeve along said nut.

20. The wildlife protector guard according to claim 10 wherein said stud has first and second nuts threaded thereto, said mounting segment of said domed cap portion has an axially extending sleeve initially engaging said second nut and axially sliding therealong and then engaging said first nut and axially sliding therealong to locate and mount said guard on said stud, the cumulative axial span of said first and second nuts providing extended axial engagement span along said sleeve.

21. The wildlife protector guard according to claim 20 wherein said second nut is axially spaced from said first nut by an axial gap therebetween.

22. The wildlife protector guard according to claim 10 wherein said termination extension section of said guard comprises an axially extending sidewall spaced radially outwardly of said termination, said second outer lip of said termination extension section defining said termination opening is spaced radially outwardly of said termination by a radial gap therebetween, and wherein said mounting segment of said dome shaped cap portion mounts said guard to said stud and centers said guard on said stud such that said radial gap is constant around an annulus between said termination and said second outer lip of said termination extension section, wherein said mounting segment has an axially extending sleeve engaging said stud and axially slidable therealong and having sufficient axial span to locate and mount said guard on said stud in centered relation and resisting rocking of said guard on said stud such that said radial gap around said annulus remains substantially constant.

23. The wildlife protector guard according to claim 22 wherein said stud includes a nut threaded thereto, and said sleeve is axially slidable along said nut.

24. A wildlife protector guard for a high voltage electrical termination in a high voltage electrical power distribution system, said termination extending axially along an axis to an axial end for ohmic connection to a high voltage line conductor, said guard comprising an electrically insulating shell having a central section comprising a dome shaped cap portion around said ohmic connection and having a convex surface facing in a first axial direction away from said termination, and having a concave surface facing in a second opposite axial direction toward said termination, at least one line extension section extending from said convex surface axially in said first axial direction along and concentrically surrounding a given length of said line conductor connected to said ohmic connection at said axial end of said termination, said central section having a termination extension section having a sidewall extending axially in said second axial direction along a portion of said termination and spaced radially therefrom, said dome shaped cap portion having a mounting segment extending from said concave surface in said second axial direction and engaging said axial end of said termination and mounting said guard thereto.

25. The wildlife protector guard according to claim 24 wherein said at least one line extension section has a cross-sectional frusto-triangular shape.

26. The wildlife protector guard according to claim 24 wherein said termination comprises a plurality of annular skirts axially spaced therealong, and said sidewall of said termination extension section of said guard extends axially in said second axial direction axially past at least a first of said skirts closest to said ohmic connection, said sidewall extending in said second axial direction to an outer lip spaced radially outwardly of said skirts, said mounting segment mounting said guard in centered relation on said axial end such that said outer lip of said sidewall is spaced from said skirts around an annulus having a substantially constant radial gap between said skirts and said outer lip permitting wind driven rain to cleanse said skirts.

* * * * *